US005803981A

United States Patent [19]

Lordo

[11] Patent Number: 5,803,981

[45] Date of Patent: Sep. 8, 1998

[54] METHOD AND APPARATUS FOR CONTINUOUS PICKLING OF METAL STRIP

[75] Inventor: Richard Lordo, West Middlesex, Pa.

[73] Assignee: Danieli Wean, A Division of Danieli Corporation, Youngstown, Ohio

[21] Appl. No.: 782,935

[22] Filed: Jan. 13, 1997

[51] Int. Cl.[6] ..... C23G 1/02; C23G 3/02

[52] U.S. Cl. ..... 134/3; 134/15; 134/60; 134/64 R

[58] Field of Search ..... 134/3, 10, 15, 134/60, 64 R, 122 R; 266/112; 68/181 R

[56] References Cited

U.S. PATENT DOCUMENTS

| | | | |
|---|---|---|---|
| 2,314,369 | 3/1943 | Reed | 148/8 |
| 2,381,652 | 8/1945 | Dishauzi | 266/7 |
| 2,697,050 | 12/1954 | Barnes | 134/15 |
| 3,100,727 | 8/1963 | Labergere | 134/60 X |
| 4,039,349 | 8/1977 | Kwasnoski et al. | 134/10 |
| 4,807,653 | 2/1989 | Cipriano et al. | 134/64 R |
| 4,901,744 | 2/1990 | Hansen | 134/64 R |
| 4,928,717 | 5/1990 | Osarek et al. | 134/64 R |
| 4,986,291 | 1/1991 | Hula et al. | 134/122 R |
| 5,116,447 | 5/1992 | Kimura et al. | 156/345 |
| 5,179,967 | 1/1993 | Mattiussi | 134/64 R X |
| 5,454,388 | 10/1995 | Glaiman et al. | 134/64 R |
| 5,466,309 | 11/1995 | Davene et al. | 148/508 |
| 5,476,112 | 12/1995 | Matsui et al. | 134/64 R |

FOREIGN PATENT DOCUMENTS

| | | | |
|---|---|---|---|
| 1126699 | 3/1962 | Germany | 134/64 R |
| 188787 | 8/1987 | Japan | 134/15 |
| 20487 | 1/1991 | Japan | 134/15 |
| 111584 | 5/1991 | Japan | 134/15 |

*Primary Examiner*—Philip R. Coe
*Attorney, Agent, or Firm*—Armstrong, Westerman, Hattori, McLeland & Naughton

[57] ABSTRACT

Method and apparatus for continuous pickling of metal strip comprises a series of pickling tanks in which the strip is submerged in pickling liquid in a caternary loop and wherein passage of the strip through the liquid produces a low liquid level at a strip entry end of each tank and a high liquid level end at a strip exit end of each tank, piping external to the tanks is provided through which pickling liquid cascades from the high liquid level end of one tank to the low liquid level end of an adjacent tank upstream thereof in a direction opposite the direction of strip travel. Valves in the cascade piping control the amount of pickling liquid flowing in the cascade piping. Pickling tank bottoms are sloped at either end to increase stirring action of the moving strip, and a holding tank or plurality of holding tanks are provided to empty the pickling tanks for repair and maintenance.

12 Claims, 3 Drawing Sheets

METHOD AND APPARATUS FOR CONTINUOUS PICKLING OF METAL STRIP

BACKGROUND OF THE INVENTION

1. Field of the Invention

This invention relates to new and improved methods and apparatus for the continuous pickling of metal, e.g. steel, strip, particularly wherein pickling acid solution is recirculated by means of piping and flow control valves external to the pickling tanks.

2. Description of the Prior Art

Continuous pickling of steel strip is old in the art and involves the passing of the strip successively through a series of pickling tanks holding an acid pickling solution, and wherein the strip passes over dams disposed between the tanks and the strip is submerged in the pickling solution in each tank in the form of a caternary loop between adjacent dams.

Such prior art pickling lines are substantially self-contained, having heat exchangers built into the tank side walls, and movement of the strip through the successive tanks to some extent circulate the acid pickling solution by liquid drag of the strip, wherein the amount of such circulation is dependent on strip speed. Such tanks are flat-bottomed, relatively deep and contain a large volume of acid pickling solution. Acid at the bottoms of the tanks have little stirring action as a result of the drag by the moving steel strip and, therefore, allow a build-up of iron content in the pickling solution at the bottoms of the tanks, thus slowing down the pickling process.

Another shortcoming of such prior art pickling tanks is that there is no acid solution outlet at the strip exit end of a tank where the reacted acid is pushed by the moving strip action.

The geometry of the dams and tanks, and the relationship of the dams to the liquid level in the tanks is such that acid pickling solution cascades around the dams from one tank to the next upstream tank, that is, the adjacent tank in a direction opposite to the direction of strip travel. Cascading of the pickling acid solution from tank to tank is accomplished by adding fresh acid in the last tank, and cascading takes place in a direction opposite to the strip travel direction, that is "upstream". Such cascading of acid pickling solution has problems in that the acid solution can readily mix between tanks as line speeds fluctuate, causing an imbalance in acid concentration which adversely affects the pickling process.

Continuous efforts are being made to increase the efficiency of pickling tanks and processes, and to reduce maintenance requirements.

SUMMARY OF THE INVENTION

The present invention provides a series, e.g. four, of pickling tanks wherein strip, continuously passed through the tanks, pushes or drags the acid pickling solution from a strip entering end of a tank to a strip exit end, thus creating a low liquid level end and a high liquid level end in each tank. External piping connects a high liquid level end of each tank to a low liquid level end of an adjacent upstream tank. Fresh acid is added to a last, e.g. fourth, tank and cascades, through external piping, to the low liquid level end of the next upstream tank, e.g. the third tank; from the high end of the third tank to the low end of the second tank, and from the high end of the second tank to the low end of the first tank. The moving strip pushes the acid pickling solution to the strip exit end of the tank (the "high end"), forcing the reacted acid out of the outlet pipe of the high liquid level end of the tank and cascaded to the strip entry end (the "low end") of the next upstream tank via the external piping. The amount of acid allowed to so cascade from one tank to another is restricted by control valves disposed in the external piping.

Additionally, the tanks of the present invention are provided with sloping bottoms to prevent formation of pockets trapping high iron content pickling solution and allowing the strip movement to stir the pickling solution more completely.

Further, a single holding tank for the pickling tanks may be provided, or each of the pickling tanks of the invention may be provided with holding tanks for holding the acid pickling solution contained in the pickling tanks, e.g. for repair and maintenance of the pickling tanks.

DESCRIPTION OF PREFERRED EMBODIMENTS

Figure 1:
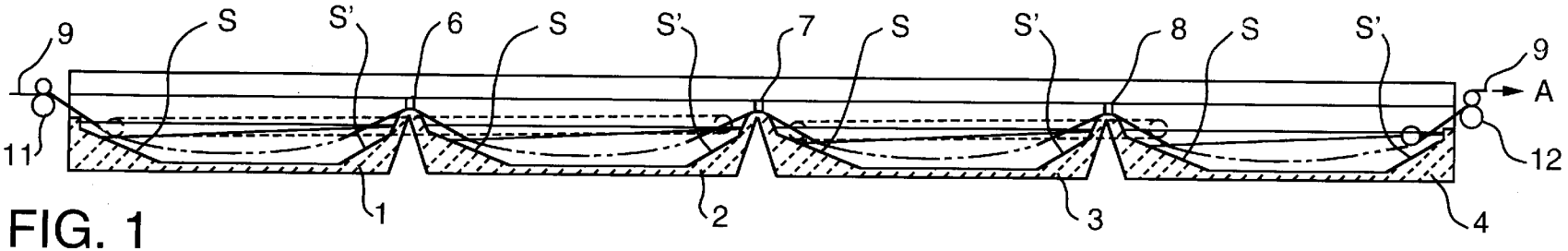
FIG. 1 is a side elevation of a series of four pickling tanks in accordance with the present invention.

In FIG. 1 the numeral 5 denotes generally a pickling line in accordance with the invention. Line 5 comprises a plurality of pickling tanks, four being illustrated in FIG. 1, i.e. tank numbers 1, 2, 3 and 4, separated by first to third dams 6, 7 and 8, and wherein strip 9 passes, in a caternary loop, through each tank and over the respective dams therebetween. Entry roll pair 11 and exit roll pair 12 support the strip through the tanks in the direction indicated by arrow A. Conventional external power systems such as bridles or pinch rolls (not shown) propel the strip through the pickling tanks.

Figure 2:
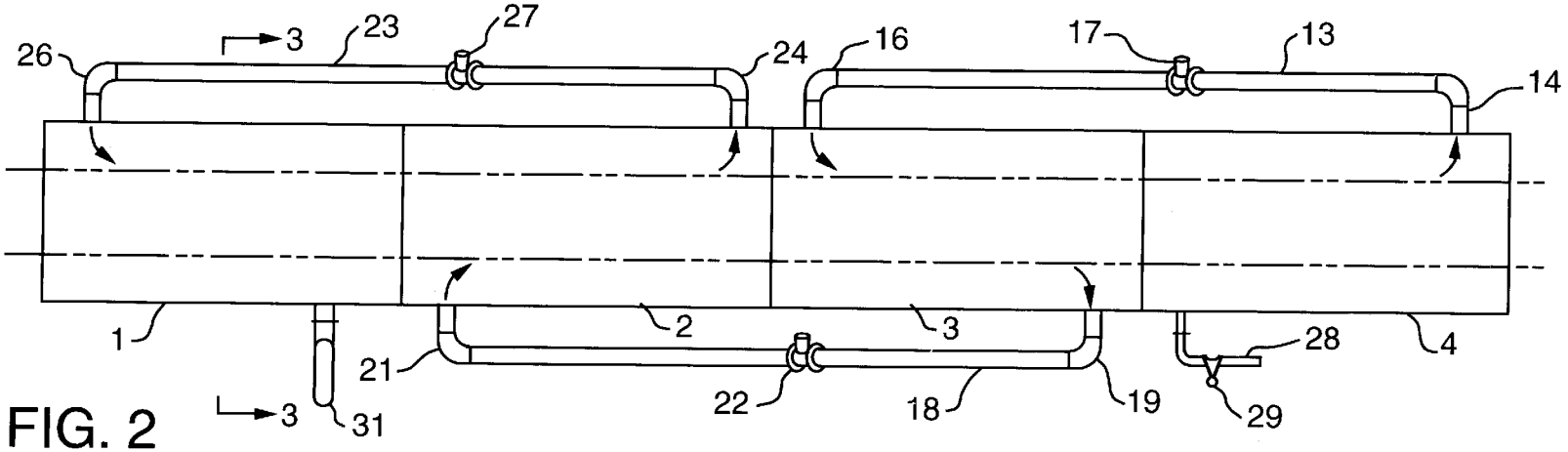
FIG. 2 is a top plan view of the pickling tanks of FIG. 1.

In FIG. 2 there is shown the external piping for cascading of acid pickling solution from one tank to a next. Pipe 13 comprises a liquid inlet 14 at the high end of tank 4 and a liquid outlet 16 at the low end of tank 3. As strip is passed through each tank containing acid pickling solution, the liquid is dragged from one end of the tank, i.e. the end at which the strip enters the tank and toward the other end of the tank, i.e. the end of the tank where the strip exits the tank. As a result, the liquid level in the tank varies from a lower level at the strip entry end of the tank (the low end of the tank) to a higher level at the strip exit end of the tank (the high end of the tank). Therefore, inlet 14 of pipe 13 is disposed toward the high end of tank 4 and slopes downwardly to exit 16 of pipe 13 disposed at the low end of tank 3, so that liquid entering pipe 13 at inlet 14 flows under the force of gravity to exit 16. Flow of liquid through pipe 13 is controlled by valve 17.

Similarly, pipe 18 has an inlet 19 disposed at the high end of tank 3 and an exit 21 disposed at the low end of tank 2, and liquid flow in pipe 18 is controlled by means of valve 22; and pipe 23 has an inlet 24 disposed at the high end of tank 2 and an exit 26 disposed at the low end of tank 1, and liquid flow in pipe 23 is controlled by means of valve 27.

Figure 3:
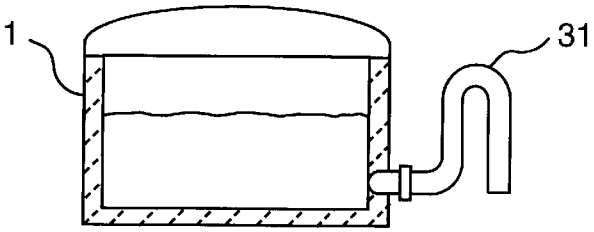
FIG. 3 is a cross sectional elevation taken along line X—X of FIG. 2.

Fresh acid is introduced into the last tank, i.e. tank 4 in the illustration of FIG. 2, through an acid inlet pipe 28, and the amount of acid so introduced is controlled by means of valve 29. A pickling tank overflow pipe 31 is provided in the first tank, i.e. tank 1 as shown in FIGS. 2 and 3.

Figure 4:
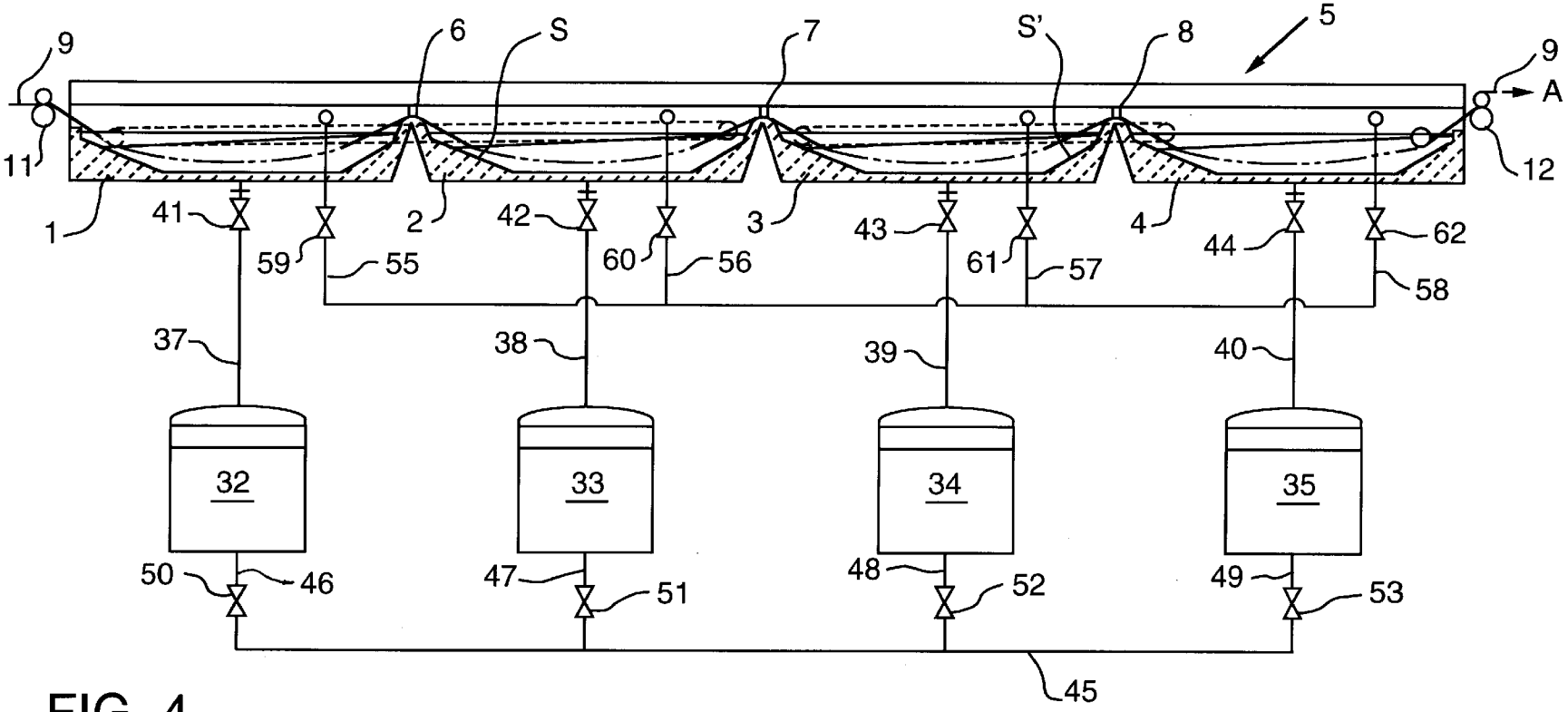
FIG. 4 is a side elevation similar to FIG. 1, and showing the holding tanks provided for each of the pickling tanks.

As shown in FIG. 4, each pickling tank may be provided with an off-line holding tank, as tanks 32–35. Acid pickling solution may be introduced from the several pickling tanks into the respective holding tank by gravity, through lines 37–40 and with the use of valves 41–44. The acid solution may be returned to its respective tank through lines 46–49 and valves 50–53, through line 45, then by means of pump 36 through lines 55–58 and with the use of valves 59–62.

Figure 5:
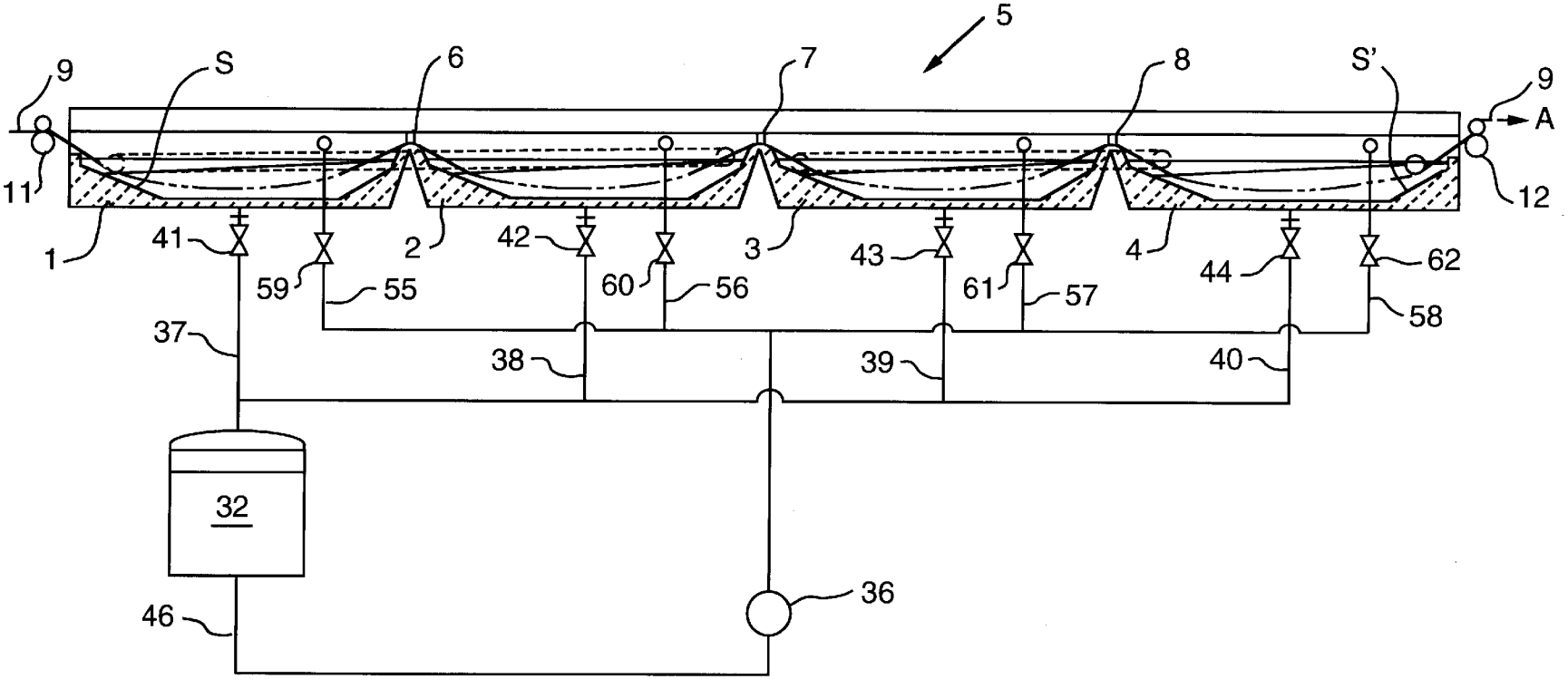
FIG. 5 is a side elevation similar to FIG. 1, showing a single holding tank provided for use with the plurality of pickling tanks.

Tanks 32–35 could be replaced by one tank 32 and with the valves shown, direct the pickling solution to its respective tank. See FIG. 5.

Although pumps may be used to assist the flow of liquid through pipes 13, 18 and 23, this is not necessary since the cascading acid pickling solution flows naturally under the influence of gravity and the pressure built up at the high end of each tank. Therefore, the pickling line of the invention has the advantage of not needing any off-line pumps requiring maintenance. Heat exchangers may be retained in the tanks themselves, so that the pickling line of the invention does not need any off-line heat exchangers requiring maintenance. Use of the invention maintains definite and controllable acid concentrations between tanks by means of external pipes 13, 18 and 23 and control valves 17, 22 and 27. The pickling tanks of the invention, with the sloping bottoms, S and S', as shown, are more shallow and require less acid pickling solution than prior art tanks; moreover, this tank design avoids formation of pockets of unstirred liquid and are less prone than prior art tanks to the formation of iron build-up in the tank. To the extent that more stirring is required, a stirring pump can be added, for example, when line speed is very low and the strip speed will not stir the pickling solution properly. Greater lengths of strip can be submerged in the tanks in the same tank length because of lower dam heights used due to the cascading of acid pickling solution in the external pipes rather than around the dams. With use of the holding tanks, it becomes possible to hold the acid pickling solution in a holding tank for predetermined times by use of the closing valves as shown and described. No wringer rolls are required.

The overall result is a pickling line of greater efficiency and requiring less maintenance than prior art pickling lines.

What is claimed is:

1. A continuous acid pickling line of improved pickling efficiency comprising a plurality of pickling tanks disposed in series arrangement wherein each pair of adjacent tanks is separated by a dam over which a metal strip to be pickled is passed and is submerged in pickling solution in the form of a caternary loop in each tank and wherein the moving strip drags pickling solution from a strip entry end of the tank to a strip exit end of the tank thereby providing a low liquid level end of the tank and a high liquid level end of the tank, the improvement which comprises a pickling solution cascade pipe disposed externally of each tank and having an entry end communicating with the interior of a first tank at the high liquid level end of the tank and an exit end communicating with the interior of a second tank adjacent the first tank and disposed upstream of the first tank in a direction opposite to the direction of strip movement and at the low liquid level end of the second tank, said cascade pipe sloping downwardly from the entry end thereof to the exit end thereof, whereby pickling solution is enabled to cascade under gravity from the entry end of the cascade pipe at the high liquid level end of the first tank to the exit end of the cascade pipe at the low liquid level end of the second tank.

2. A pickling line according to claim 1, further comprising a control valve in the cascade pipe to control the flow of pickling solution through the cascade pipe.

3. A pickling line according to claim 2, further comprising means to add fresh pickling solution to a last tank in the series of pickling tanks.

4. A pickling line according to claim 3, further comprising a pickling solution overflow pipe communicating with the interior of a first tank in the series of pickling tanks.

5. A pickling line according to claim 4, wherein a bottom of each pickling tank is sloped at each end of the tank.

6. A pickling line according to claim 5, further comprising a holding tank for each pickling tank, valve means for controlling flow of pickling solution from each pickling tank to a corresponding holding tank, and means to return pickling solution from a holding tank to a corresponding pickling tank.

7. A pickling line according to claim 5, further comprising a single holding tank for said series of pickling tanks, valve means for controlling the flow of pickling solution from said series of pickling tanks to said single holding tank, and means to return pickling solution from said single holding tank to said series of pickling tanks.

8. A continuous metal strip pickling line comprising a plurality of serially arranged pickling tanks, means to pass a metal strip continuously through the tanks whereby pickling liquid is pushed from a low liquid level end of each tank corresponding to a strip entry end of the tank to a high liquid level end of the tank corresponding to a strip exit end of the tank, and piping means external to the tanks to cascade pickling liquid from the high liquid level end of each tank to a low liquid level end of an adjacent tank upstream thereof in a direction opposite to the direction of strip travel.

9. A pickling line according to claim 8, further comprising means to control the flow of pickling solution in the piping means from one tank to another.

10. A method of continuous pickling of metal strip, comprising continuously passing the strip through a series of pickling tanks containing a pickling liquid wherein passage of the strip through the liquid pushes liquid from a low liquid level strip entry end of each tank to a high liquid level strip exit end of the tank, and cascading pickling liquid through external piping from a high liquid level end of each tank to a low liquid level end of an adjacent tank upstream thereof in a direction opposite to the direction of movement of the strip.

11. A method according to claim 10, further comprising controlling the flow of pickling liquid in the external piping.

12. A method according to claim 11, wherein the controlling of pickling liquid flow is achieved by means of valves in the external piping.

* * * * *